United States Patent [19]

Katsanis et al.

[11] Patent Number: 4,727,789

[45] Date of Patent: Mar. 1, 1988

[54] VENTED SUPPRESSIVE SHIELDING

[75] Inventors: David J. Katsanis, Pylesville; Paul W. Henderson, Bel Air, both of Md.

[73] Assignee: T & E International, Inc., Bel Air, Md.

[21] Appl. No.: 877,962

[22] Filed: Jun. 24, 1986

[51] Int. Cl.[4] ..... F42B 33/06

[52] U.S. Cl. ..... 86/50; 89/36.09; 109/49.5; 109/81; 109/85

[58] Field of Search ..... 86/50; 89/36.02, 36.04, 89/36.07, 36.09; 109/10, 11, 12, 21.5, 26, 49.5, 78, 80, 81, 85; 114/9, 10, 11, 12, 13

[56] References Cited

U.S. PATENT DOCUMENTS

| | | | |
|---|---|---|---|
| 679,326 | 7/1901 | Nederland | 114/13 |
| 1,014,510 | 1/1912 | Papendry | 114/13 |
| 1,237,883 | 8/1917 | Elia | 89/36.12 |
| 1,736,621 | 11/1929 | Platt | 109/21.5 |
| 1,761,095 | 6/1930 | Spottswood | 109/12 |
| 2,315,799 | 4/1943 | La Guardia et al. | 86/50 |
| 2,351,297 | 6/1944 | Schwab | 86/50 |
| 2,393,350 | 1/1946 | Wiedman | 109/49.5 |
| 2,405,590 | 8/1946 | Mason | 109/81 |
| 2,491,516 | 12/1949 | Piggot et al. | 86/50 |
| 3,054,349 | 9/1962 | Plumley | 86/50 |
| 3,165,916 | 1/1965 | Loving, Jr. | 86/50 |
| 3,301,041 | 1/1967 | Mueller | 86/50 |
| 3,721;201 | 3/1973 | Boller | 86/50 |
| 3,800,715 | 4/1974 | Boller | 86/50 |
| 3,820,435 | 6/1974 | Rogers et al. | 86/50 |
| 3,820,479 | 6/1974 | Fylling | 86/50 |
| 4,027,601 | 6/1977 | Hickerson | 86/50 |
| 4,046,055 | 9/1977 | McDanolds et al. | 86/50 |
| 4,248,342 | 2/1981 | King et al. | 206/3 |
| 4,325,309 | 4/1982 | King et al. | 109/49.5 |
| 4,326,468 | 4/1982 | King et al. | 109/49.5 |
| 4,347,796 | 9/1982 | King et al. | 109/49.5 |

FOREIGN PATENT DOCUMENTS

| | | | |
|---|---|---|---|
| 333846 | 4/1920 | Fed. Rep. of Germany | 109/26 |

OTHER PUBLICATIONS

Webster's New World Dictionary of the American Language, "Porthole", 1957, p. 1139.

*Primary Examiner*—Stephen C. Bentley

*Attorney, Agent, or Firm*—Cushman, Darby & Cushman

[57] ABSTRACT

A vented suppressive shielding device which may be used in either a permanent building placent or portable device to protect persons or equipment from the effects of an explosive detonation. The shielding is relatively lightweight and comprises a shielding barrier having a frame means, the frame means carrying at least two barrier means in selected position relative to one another. The shielding barrier has oppositely facing surface members, wherein one of these surface members is disposed so as to face an explodable device, with the other surface facing away from the explodable device. Each one of the barrier means is located adjacent to one of the surface members such that one of the barrier means is free to move in the space defined by the frame means and relative to the frame means.

10 Claims, 4 Drawing Figures

VENTED SUPPRESSIVE SHIELDING

This invention generally relates to a versatile vented suppressive shielding device which may be used to protect persons or equipment from the effects of an explosive detonation.

BACKGROUND

The use of certain types of suppressive shielding for the containment of explosive blasts is known. For example vented blasting mats have long been used in quarry operations to confine detonation effects. The design of such mats was primarily achieved through trial and error. More recently the application of suppressive shielding has been considered for use in other commercial and military applications.

In military applications suppressive shielding development has been generally directed to the containment of an expolsion within a shielding. The blast, fragments and fireball which accompany such a contained explosion, for example the detonation of a round used for a large caliber weapon, can be considered a worst case test for a shielding container, therefore success in such an application would allow the use of such shielding—in a reversed mode—to protect from an exterior threat.

An explosive suppressive shielding has many important applications. For example, such shielding can be used in transportation terminals such as airports and bus stations where terrorist-type attacks can occur. The shields may take many forms in such an application. For instance, a suppressive shielding container may be used for explosives storage at baggage checkpoints. Such a shielding container may also be made to be placed on an aircraft where any explosive device could be placed until proper evacuation is possible.

Larger suppressive structures may be used to provide protection where a greater area of suppression is desired. Thus, a shielding barrier type jacket may be placed around wall lockers at an airport.

Of course, applications for such a shield are not limited to airports and other transportation facilities. In an industrial plant, for example, equipment subject to explosion may be surrounded by a suppressive shield in order to protect workers. Where it is desired to protect an enclosure from outside explosion, such a shield may be reversed, so that occupants in an industrial control room could be protected.

Such vented suppressive shielding also has military applications. Explosive devices may be stored within a shielded container or larger shields may be used to surround explosive storage areas. As with industrial applications, and more so with military uses, the suppressive shielding can be reversed to provide protection for equipment and personnel from explosive detonations occurring outside the barrier. Such a shielding barrier requires that the shield have the ability to withstand not only high pressure waves and a fireball, but also high velocity frgments that invariably are part of military munitions.

Where transportation of dangerous explosives is necessary, shielding is especially desirable. This is true, for example, with the transportation of dynamite and percussion caps to the area of use. In this instance a suppressive shielding container must be relatively small and lightweight.

The problem of providing a useful suppressive shielding are many. Concrete revetments/walls and steel shelters can often provide sufficient shielding, but are too bulky and heavy to provide the various types of protection mentioned above. Such shields often inhibit movement of people or machines because of their large size. Also, the construction of portable shields of these materials is not possible because of their weight and bulk.

Because of the foregoing there has been a need for a suppressive shielding which is relatively light and not bulky, but which will still provide sufficient protection from the blast pressure, heat, flame and fragments which may accompany an explosion.

SUMMARY OF THE INVENTION

A relatively lightweight suppressive shielding compared to steel and concrete which provides protection from the effects of an explosive blast has been developed. This shielding comprises a shielding barrier having a frame means, the frame means carrying at least two barrier means in selected positions relative to one another. The shielding barrier has oppositely facing surface members, wherein one of these surface members is disposed so as to face an explodable device, with the other surface facing away from the explodable device. Each one of the barrier means is located adjacent to one of the surface members such that one of the barrier means is free to move in the space defined by the frame means and relative to the frame means. The components of the barrier may be made from heavy gauge aluminum or steel, as is required in a particular application..

In this manner the shock wave, heat, flame and fragments of an explosion can be contained, even in a portable device.

DETAILED DESCRIPTION OF THE DRAWINGS

Figure 1:
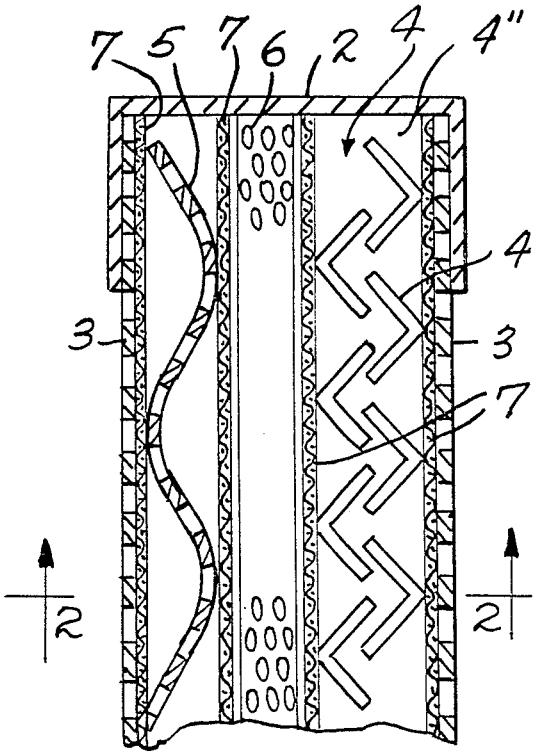
FIG. 1 is a cross-sectional view, along lines 1—1 of FIG. 2 showing the structure of the suppressive shielding wall.

The invention will now be described with reference to FIGS. 1–4. FIG. 1 i a cross-sectional end view of the structure of the suppressive shielding wall showing the position of each component of the shield. It may be noted that the components of the shield, as described below, will generally be made from heavy gauge steel or aluminum. As described below, however, the shape, positioning, and types of materials used will vary according to the desired degree of protection.

Referring to FIG. 1, the position of an explosive device relative to the suppressive shielding barrier is indicated by letter A. The components of the shielding barrier 1 are supported by U-shaped frame member 2. Held rigidly within the U-shaped frame member 2 are surface members 3 which may be perforated sheet metal. In this instance, the term "rigidity" is used to describe the setting of surface members 3 against supporting frame member 2, and does not mean that surface members 3 are welded or otherwise fixedly attached to frame member 2. Rather, as will be described below, the internal components of shielding barrier are designed and positioned such that outward forces act upon the inner portions of surface members 3 to hold the surface members 3 rigidly against supporting frame member 2. No welding or bolting is required or desired.

Within frame member 2 are positioned at least two barrier means, at least one of which is a louvered member, such as louvered members 4 shown in FIG. 1. These louvered members 4 are arrayed in such a manner that a projectile or piece of shrapnel may not pass through the shielding barrier without contacting at least some portion of one of the slat 4' members. In the embodiment shown in FIG. 1, louver slats 4' are of V-shaped cross-section and are staggered relative to one another to achieve this goal. As shown in FIG. 1, the louver slats include a first array of louvered slats or members all extending substantially in the same plane, while the second array of louver members all extend substantially in another plane spaced from the plane of the first array. In order to ensure that a projectile is intercepted by the louvered members 4, the first array is set apart from the second array by a selected distance.

The louvered members are rigidly held in place relative to a movable subframe more particularly described with reference to FIG. 2 below.

Still referring to FIG. 1, it can be seen that the second barrier of this preferred embodiment includes two relatively stiff heavy gauge metal sheets 5 and 6. Sheets 5 and 6 undulate in the manner of corrugated sheet with the undulations or corrugations along the sheets 5 running at right angles to the corrugations of sheets 6. It is chiefly these corrugations that make the shielding barrier an excellent shock absorber. Corrugated sheets 5 and 6 also provide the outward directed forces which hold surface members 3 ridigly in position against supporting frame member 2. Relatively stiff corrugated sheets 5 and 6 provide a large flexing surface area over which the force of a blast may be spread allowing for improved dissipation of the blast forces.

As is seen in FIG. 1, surface members 3 each contain a number of apertures. These apertures are arranged such taht they are not aligned in sheets 3, 5 and 6. In this manner, the pressure wave and gases produced during an explosion are allowed to pass through the surface members of the shielding barrier. Since the apertures of the various sheets are not aligned, however, the moving pressure wave is forced to change direction thereby redirecting some of the force of the blast.

As previously mentioned, the three main problems to be addressed in any containment device or barrier are blast force, debris, including projectiles and fireball. In order to control each of these the shielding barrier further comprises screens 7. These screens 7 are positioned adjacent to and held rigidly against the inner portion of each surface member in the preferred embodiment shown in FIG. 1. Screens 7 are also included adjacent to the inner surfaces of the two barrier means. The screens will generally be of small mesh wire of aluminum or steel composition. These screens assist in the dissipation of the fireball which may accompany a blast.

The components of the present shielding barrier 1 included as shown in FIG. 1 provide for an effective yet relatively light barrier which may be used to contain blasts in a portable vehicle or in a permanent building placement. The barrier walls may be used as permanently set walls in such a portable vehicle or may be produced in panel type structures which can be used for modular construction. It should especially be noted that since each of the barrier means within the shielding barrier is rigidly set in place, yet is movable relative to the frame, the forces which accompany a blast are much more effectively controlled than when using those shields previously known.

Figure 2:
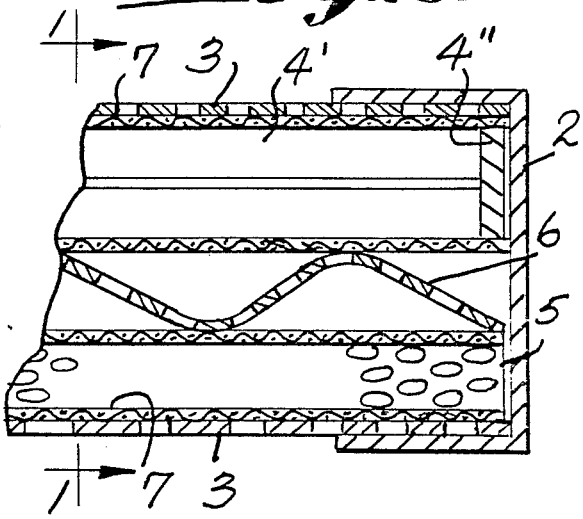
FIG. 2 is a cross-sectional view, along lines 2—2 of FIG. 1 showing the structure of the suppressive shielding wall structure.

FIG. 2 is a cross-sectional view along lines 2—2 of FIG. 1 of the structure of the suppressive shielding barrier 1 shown in FIG. 1. In this figure, metal sheets 5 and 6 are again shown held within frame member 2, and disposed adjacent to louvered members 4. FIG. 2 clearly shows the mechanism by which louvered members 4' are made movable within the shielding barrier. Louvered members 4 are welded or otherwise fixedly attached to a pair of spaced plate members 4''. This creates a subframe within the shielding barrier consisting of the spaced plate members such as 4'', with each end of each louver member fixed to one of the plate members 4''. Importantly, the plate members 4'' are held in place by screens 7, and the force generated by corrugated sheets 5 and 6, which force the louvered subframe against surface member 3.

Figure 3:
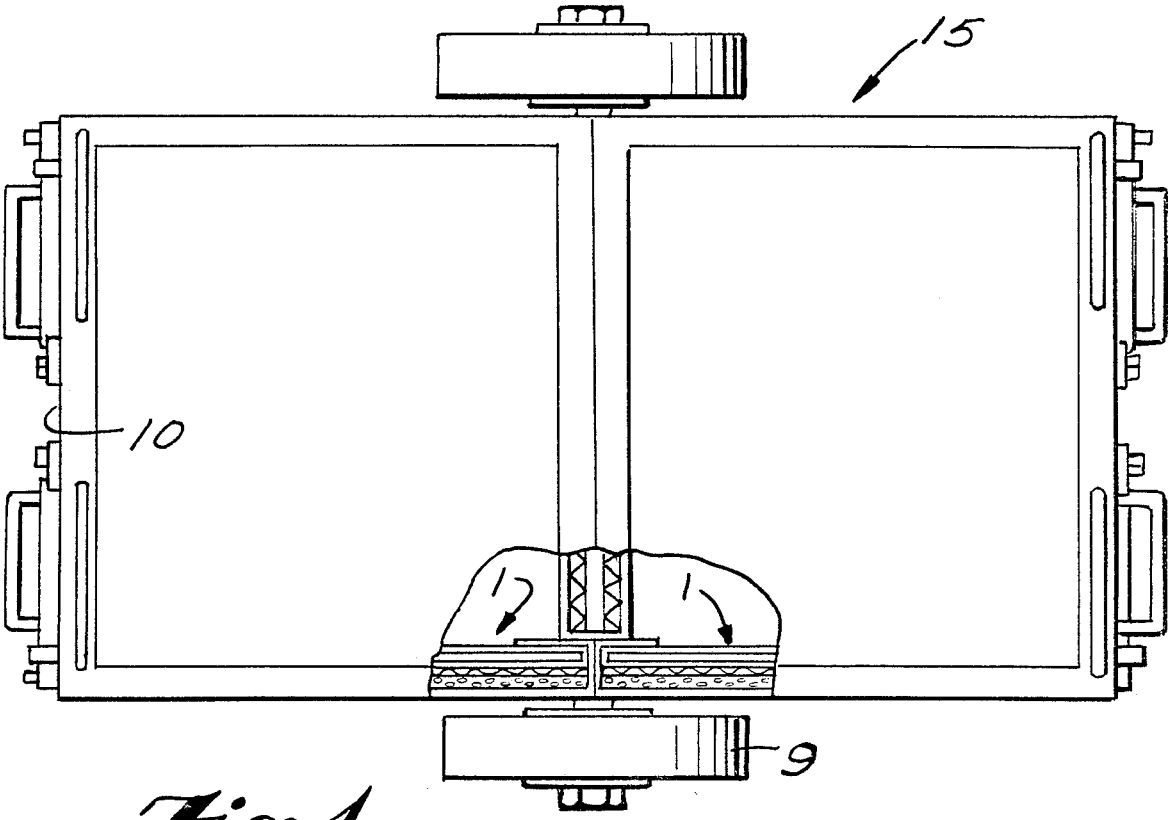
FIG. 3 is a cutaway top view of a portable, wheeled containment vehicle utilizing the suppressive shielding structure of the present invention.
Figure 4:
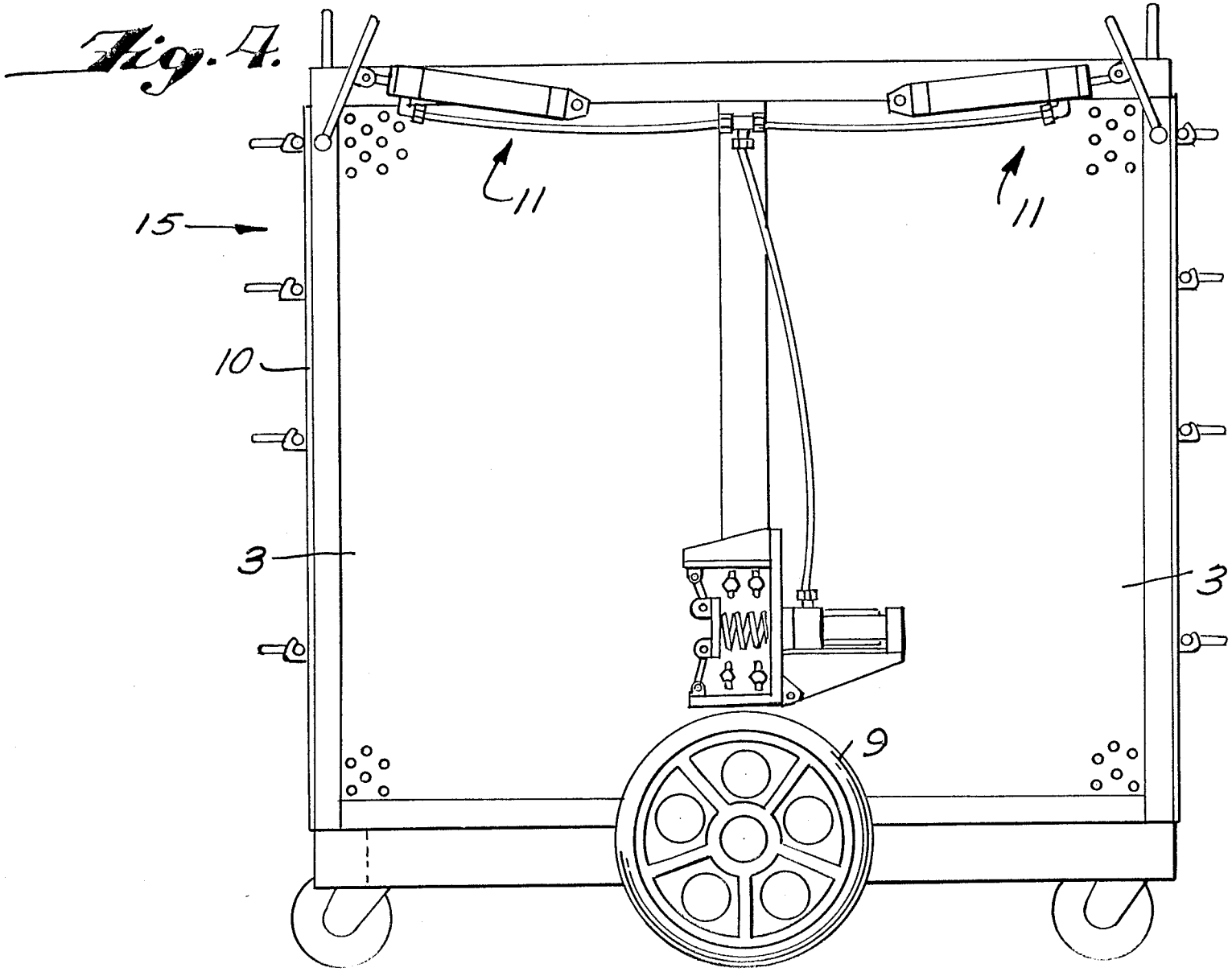
FIG. 4 is a side view of the portable containment vehicle shown in FIG. 3.

FIG. 3 shows a portable containment device utilizing the shielding barrier of the present invention. FIG. 3 is a cutaway top view of a portable wheeled containment vehicle 15. As can be seen in the cutaway portion walls 1 constructed according to the present invention are disposed along the perimeter of the vehicle. A side view of such a vehicle is shown in FIG. 4. Such a vehicle will, of course, utilize wheels 9, and will have end doors 10. End doors 10 will be held in place, once an explosive device is placed inside, by a system of automatic closing devices 11, such as pneumatic cylinders. The closing system may be controlled remotely.

As shown in FIG. 4, the side wall surface of the containment vehicle is in fact a surface member of the shielding barrier.

As noted previously, the shielding barrier may be constructed in modular units for use in containment devices such as shown in FIGS. 3 and 4, or, may be made in larger or smaller sizes and incorporated into various types of structures to achieve protection when needed.

Although only an exemplary embodiment of the invention has been described in detail, those skilled in the art will recognize that many modifications and variations in this shielding barrier may be made while retaining many of the novel features and advantages of the invention. Accordingly, all such variations and modifications are intended to be within the scope of the appended claims.

What is claimed is:

1. In a ventilated, porous structure for an explodable device, a shielding barrier having a frame means carrying at least two barrier means in selected positions relative to one another, said shielding barrier having oppositely facing surface members and one of said surface members being disposed to face the explodable device with the other surface member facing away from the explodable device, a first one of said barrier means being located adjacent said one of said surface members and a second one of said barrier means being disposed adjacent said other surface member, said first one of said barrier means being free to move in a space defined by said frame means and relative to said frame means, wherein said first one of said barrier means comprises louver means, and wherein said louver means includes a subframe movably carried in said frame means.

2. Invention as claimed in claim 1 wherein at least one of said oppositely facing surface members comprises wall means, said wall means having a plurality of apertures formed therethrough.

3. The invention as claimed in claim 2 wherein said wall means is a metal plate having a thickness substantially less than the thickness of said shielding barrier.

4. The invention as claimed in claim 2 wherein the other of said oppositely facing surfaces comprises another wall means having apertures formed therethrough with said apertures of said one surface member being out of alignment with a substantial number of the apertures of said other of said oppositely facing surfaces.

5. The invention as claimed in claim 2 wherein said wall means has an interiorly facing surface having screen means disposed adjacent thereto and which is substantially co-extensive therewith.

6. The invention as claimed in claim 1 wherein said louver means comprise a plurality of louvers which are V-shaped in cross-section.

7. In a ventilated, porous structure for an explodable device, a shielding barrier having a frame means carrying at least two barrier means in selected positions relative to one another, said shielding barrier having oppositely facing surface members and one of said surface members being disposed to face the explodable device with the other surface member facing away from the explodable device, a first one of said barrier means being located adjacent said one of said surface members and a second one of said barrier means being disposed adjacent said other surface member, said first one of said barrier means being free to move in a space defined by said frame means and relative to said frame means, wherein said first one of said barrier means comprises louver means, wherein said louver means includes a first array of louver members all extending substantially in the same plane and a second array of louver members all extending substantially in another plane spaced from said same plane, wherein said louver means includes a subframe movably carried in said frame means, said subframe comprising a pair of spaced plate members with one end of each of said louver members fixed to one of said plate members and the opposite end of each of said louver members being fixed to the other of said plate members.

8. The invention as claimed in claim 7, wherein said ends of said louver members are welded to respective said plate members.

9. The invention as claimed in claim 7 wherein said louver means comprise a plurality of louvers which are V-shaped in cross-section.

10. The invention as claimed in claim 7 wherein said louver members of said first array are each spaced from an adjacent said louver member of said first array by a selected distance, said louver members of said second array being spaced from an adjacent said louver member of said second array and said louver members of said second array being offset relative to said louver members of said first array so that a projectile incident on said plane of said first array cannot pass said louver means without striking at least one of said arrays of louver members.

* * * * *